US011623782B2

(12) United States Patent
Little et al.

(10) Patent No.: US 11,623,782 B2
(45) Date of Patent: Apr. 11, 2023

(54) TWO-PIECE CONTAINER WITH INTEGRAL INTERNAL CORNER SUPPORTS

(71) Applicant: YORK CONTAINER COMPANY, York, PA (US)

(72) Inventors: Troy M. Little, Thomasville, PA (US); Thomas E. DeCello, Spring Grove, PA (US)

(73) Assignee: YORK CONTAINER COMPANY, York, PA (US)

( * ) Notice: Subject to any disclaimer, the term of this patent is extended or adjusted under 35 U.S.C. 154(b) by 0 days.

(21) Appl. No.: 17/446,057

(22) Filed: Aug. 26, 2021

(65) Prior Publication Data

US 2023/0069792 A1 Mar. 2, 2023

(51) Int. Cl.

| | |
|---|---|
| ***B65D 5/44*** | (2006.01) |
| ***B65D 5/16*** | (2006.01) |
| ***B65D 5/00*** | (2006.01) |
| ***B65D 5/02*** | (2006.01) |
| ***B65D 5/54*** | (2006.01) |

(52) U.S. Cl.

CPC ..... *B65D 5/0075* (2013.01); *B65D 5/02* (2013.01); *B65D 5/16* (2013.01); *B65D 5/445* (2013.01); *B65D 5/542* (2013.01)

(58) Field of Classification Search

CPC ..... B65D 5/16; B65D 5/542; B65D 5/445; B65D 5/541; B65D 5/0075; B65D 5/001; B65D 5/0281; B65D 5/02

USPC ..... 229/240, 122.32, 122, 199, 919

See application file for complete search history.

(56) References Cited

U.S. PATENT DOCUMENTS

| | | | | |
|---|---|---|---|---|
| 3,055,573 | A | 9/1962 | Carter | |
| 4,101,048 | A | 7/1978 | Rieben | |
| 4,834,255 | A * | 5/1989 | Boots | B65D 5/566 229/199 |
| 5,535,942 | A | 7/1996 | Vilona | |
| 6,712,214 | B1 * | 3/2004 | Wintermute | B65D 5/006 206/745 |
| 7,677,433 | B2 | 3/2010 | Little | |
| 7,810,707 | B2 | 10/2010 | Little | |
| 7,819,305 | B2 | 10/2010 | Little | |
| 7,861,916 | B2 | 1/2011 | Little | |
| 7,981,017 | B2 | 7/2011 | Little et al. | |
| 8,177,117 | B2 * | 5/2012 | Little | B65D 5/16 229/199 |
| 8,297,490 | B2 | 10/2012 | Little et al. | |
| 8,770,468 | B2 * | 7/2014 | Skolik | B65D 5/445 229/199 |
| 8,887,985 | B2 | 11/2014 | Laughman et al. | |
| 8,925,795 | B2 | 1/2015 | Little | |

(Continued)

*Primary Examiner* — Nathan J Newhouse
*Assistant Examiner* — Phillip D Schmidt
(74) *Attorney, Agent, or Firm* — Barnes & Thornburg LLP

(57) ABSTRACT

A retail-ready container includes internal corner supports. The container is erected from a preassembly formed from a combination including a primary blank and a secondary blank. The primary blank includes a side panel, a bottom panel, and a top panel. The secondary blank is selectively adhered to the side panel of the primary substrate. Each of the side panel and the secondary blank include a plurality of sections connected by respective fold lines. Fold lines of the side panel are laterally offset from fold lines of the secondary blank so that unfolding of the preassembly yields the container with internal corner supports.

20 Claims, 14 Drawing Sheets

(56) References Cited

U.S. PATENT DOCUMENTS

| | | | | |
|---|---|---|---|---|
| 9,022,276 | B2 * | 5/2015 | Little | B65D 5/4804 229/120.17 |
| 9,290,294 | B2 | 3/2016 | Laughman et al. | |
| 9,315,287 | B2 * | 4/2016 | Wintermute | B65D 5/445 |
| 9,434,501 | B2 | 9/2016 | Little | |
| 10,829,263 | B1 | 11/2020 | Little | |
| 2004/0074956 | A1 * | 4/2004 | Sax | B65D 5/542 229/125.05 |
| 2010/0083618 | A1 | 4/2010 | Little | |
| 2010/0087304 | A1 | 4/2010 | Little | |
| 2010/0234201 | A1 * | 9/2010 | Little | B65D 5/445 229/122.23 |
| 2011/0011922 | A1 | 1/2011 | Little | |
| 2017/0240315 | A1 | 8/2017 | Little | |
| 2021/0331827 | A1 * | 10/2021 | Gressel | B65D 5/001 |

* cited by examiner

TWO-PIECE CONTAINER WITH INTEGRAL INTERNAL CORNER SUPPORTS

BACKGROUND AND SUMMARY OF THE DISCLOSURE

Retail-ready containers with internal corner supports are known in the art. Some such containers include the corner supports as structures separate from the container itself. The present disclosure is directed to a retail-ready container including integral internal corner supports. The retail-ready container according to the present disclosure may be erected from a preassembly formed from a combination including a primary blank and a secondary blank selectively adhered to the primary blank.

DETAILED DESCRIPTION OF THE DRAWINGS

Terms herein referring to orientation, for example, top, bottom, front, rear, center, side, left, right and alike as may be used herein should be construed in a relative, rather than absolute, sense unless context clearly dictates otherwise. Embodiments shown and described herein are illustrative and should not be considered as limiting the scope of the inventions as defined by the appended claims. Features disclosed in connection with a given embodiment may be used in connection with any other embodiment to the greatest extent possible.

Figure 1:
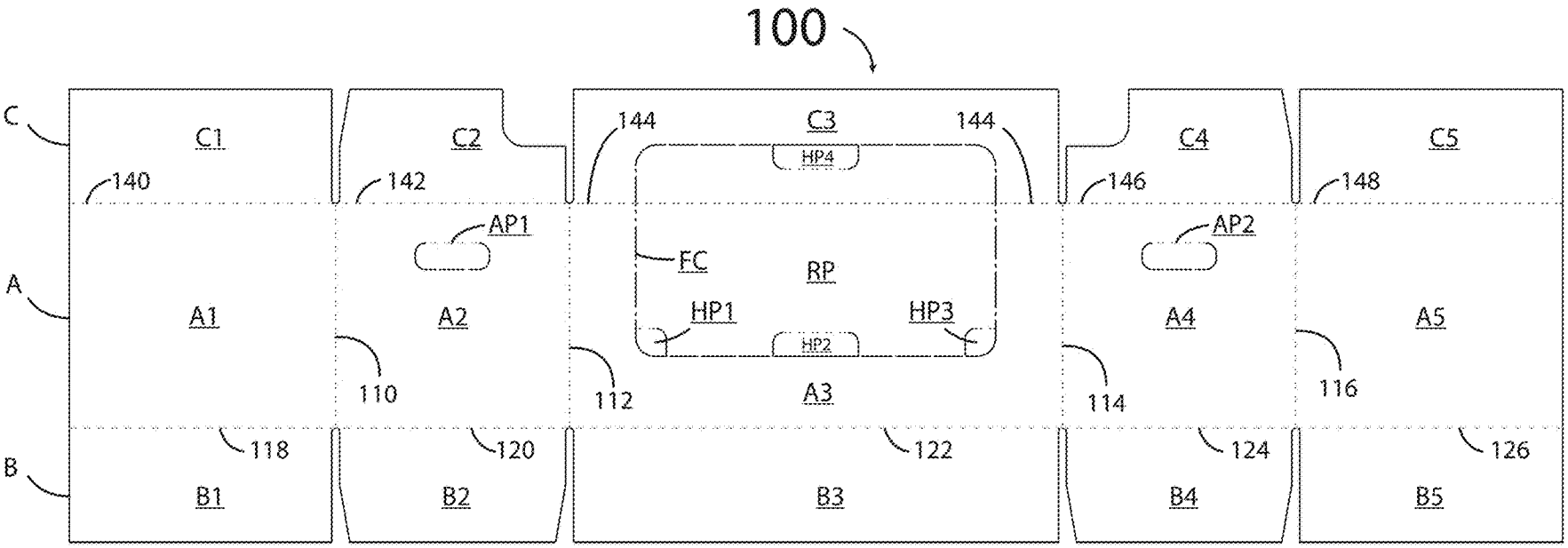
FIG. 1 is a top plan view of a primary blank according to the present disclosure.

FIG. 1 shows an inner surface of a primary blank 100 including a side panel A, a bottom panel B, and a top panel C. In embodiments, the top panel may be omitted. The side panel A includes first though fifth sections A1, A2, A3, A4, A5, as will be discussed further below. The bottom panel B includes first though fifth sections B1, B2, B3, B4, B5, as will be discussed further below. The top panel C includes first though fifth sections C1, C2, C3, C4, C5, as will be discussed further below.

Figure 2:
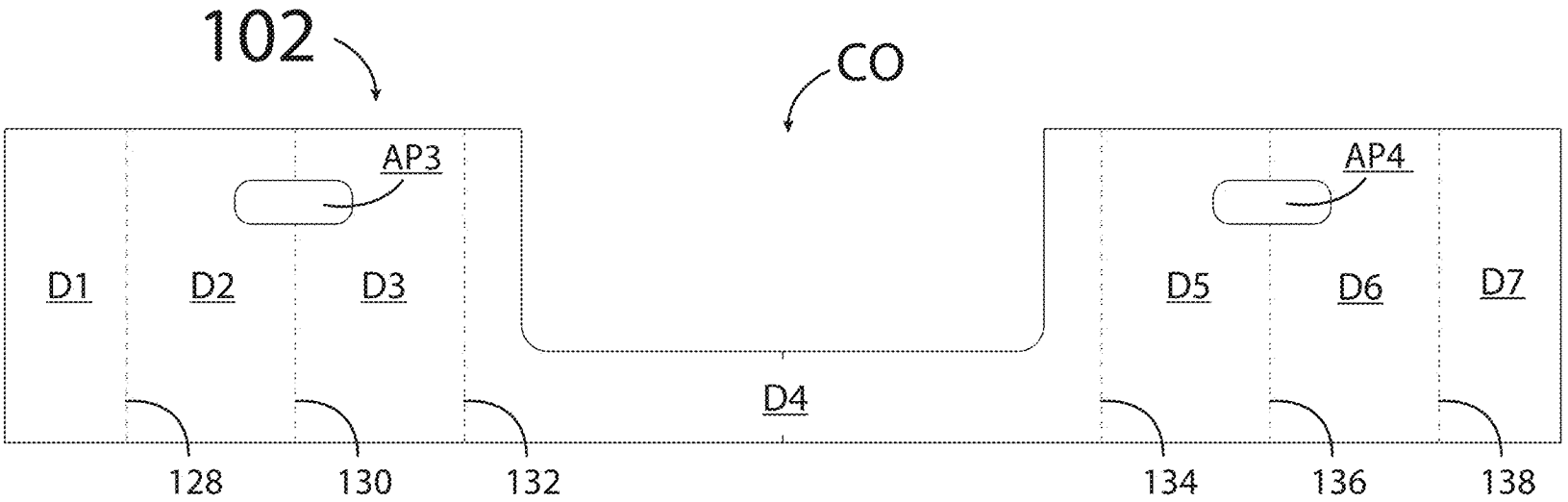
FIG. 2 is a top plan view of a secondary blank according to the present disclosure.

FIG. 2 shows an inner surface of a secondary blank 102. The secondary blank 102 includes first through seventh sections D1, D2, D3, D4, D5, D6, D7, as will be discussed further below.

The blanks 100, 102 may be made of corrugated paperboard, cardstock or another suitable material. Solid lines as shown in the drawings indicate separation of adjacent panels or sections of panels from each other. Such separation may be effected for example by lancing, sharing, dye cutting or other means that may or may not yield a kerf. Dashed lines as shown in the drawings indicate fold lines that may or may not be scored. Scoring, where provided, may be effected by perforating or creasing the blank 100. Dashed and dotted lines shown in the drawings indicate a frangible connection.

With reference to FIG. 1, the side panel A of the primary blank 100 includes a first section A1, a second section A2, a third section A3, a fourth section A4, and a fifth section A5. The first section A1 of the side panel A is connected to the second section A2 of the side panel A by a first fold line 110. The second section A2 of the side panel A is connected to the third section A3 of the side panel A by a second fold line 112. The third section A3 of the side panel A is connected to the fourth section A4 of the side panel A by a third fold line 114. The fourth section A4 of the side panel A is connected to the fifth section A5 of the side panel A by a fourth fold line 116.

The first through fourth fold lines 110, 112, 114, 116 are parallel to and laterally spaced from each other.

The second section A2 of the side panel A defines a first aperture AP1. The fourth section A4 of the side panel A defines a second aperture AP2. The first and second apertures AP1, AP2 are shown as rectangular but could take other shapes.

The bottom panel B includes a first section B1, a second section B2, a third section B3, a fourth section B4, and a fifth section B5. The first section B1 of the bottom panel B is connected to the first section A1 of the side panel A by a fifth fold line 118. The second section B2 of the bottom panel B is connected to the second section A2 of the side panel A by a sixth fold line 120. The third section B3 of the bottom panel B is connected to the third section A3 of the side panel A by a seventh fold line 122. The fourth section of the bottom panel B4 is connected to the fourth section A4 of the side panel A by an eighth fold line 124. The fifth section B5 of the bottom panel B is connected to the fifth section A5 of the side panel A by a ninth fold line 126. The fifth through ninth fold lines 118, 120, 122, 124, 126 are co-linear with each other.

With reference to FIG. 2, the secondary blank 102 has a first section D1, a second section D2, a third section D3, a fourth section D4, a fifth section D5, a sixth section D6, and a seventh section D7. The first section D1 is connected to the second section D2 by a tenth fold line 128. The second section D2 is connected to the third section D3 by an eleventh fold line 130. The third section D3 is connected to the fourth section D4 by a twelfth fold line 132. The fourth section D4 is connected to the fifth section D5 by a thirteenth fold line 134. The fifth section D5 is connected to the sixth section D6 by a fourteenth fold line 136. The sixth section D6 is connected to the seventh section D7 by a fifteenth fold line 138. The tenth through fifteenth fold lines 128, 130, 134, 136, 138 are parallel to each other.

The second and third sections D2, D3 cooperate to define a third aperture AP3. Free edges 150 of the fourth section D4 define a U-shaped cutout CO. The fifth and sixth sections D5, D6 cooperate to define a fourth aperture AP4. The third and fourth apertures AP3, AP4 are shown as rectangular but could take other shapes. With further reference to FIG. 1, the top panel C includes a first section C1, a second section C2, a third section C3, a fourth section C4, and a fifth section C5. The first section C1 of the top panel C is connected to the first section A1 of the side panel A by a sixteenth fold line 140. The second section C2 of the top panel C is connected to the second section A2 of the side panel A by a seventeenth fold line 142. The third section C3 of the top panel C is connected to the third section A3 of the side panel A by an eighteenth fold line 144. The fourth section of the top panel C4 is connected to the fourth section A4 of the side panel A by a nineteenth fold line 146. The fifth section C5 of the top panel C is connected to the fifth section A5 of the side panel A by a twentieth fold line 148. The sixteenth through twentieth fold lines 140, 142, 144, 146, 148 are collinear with each other.

The third section C3 of the top panel C cooperates with the third section A3 of the side panel A to define a removable portion RP. The removable portion RP is frangibly connected to the third section C3 of the top panel C and the third section A3 of the side panel A by frangible connection FC. The removable portion RP is shown as rectangular, but could take other shapes.

The removable portion RP cooperates with the third sections A3, C3 of the side and top panels A, C to define a first hinged panel HP1 proximate a lower left portion of the removable panel RP, a second hinged panel HP2 proximate a lower center portion of the removable panel RP, a third hinged panel HP3 proximate a lower right portion of the removable panel RP, and a fourth hinged panel HP4 opposite the second hinged panel HP2. The hinged panels HP1, HP2, HP3, HP4 are optional elements that may be used to facilitate removal of the removable panel RP, as will be discussed further below. Other embodiments may include more or fewer hinged panels at different locations and having different shapes than shown.

As mentioned above, in embodiments, the top panel C may be omitted. In such embodiments, the removable portion RP would be defined by the third section A3 of the side panel A.

In embodiments, the removable portion RP and frangible connection FC may be omitted. The space occupied by the removable portion RP as shown in the drawings could be empty or embodied as an extension of the third section A3 of the side panel A.

Figure 12:
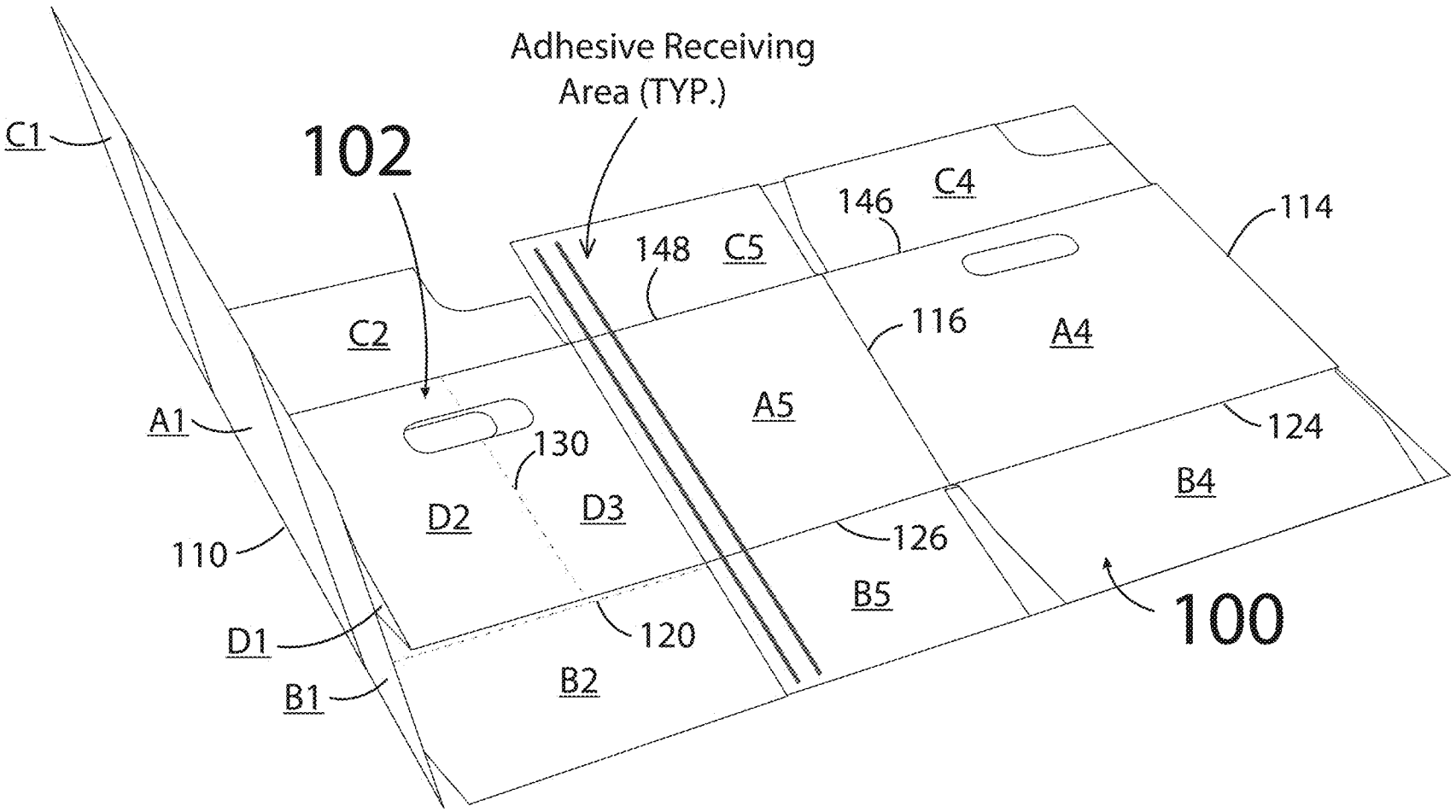
FIG. 12 is a perspective view of the combination of FIG. 10 in which the primary and secondary blanks have been further manipulated according to the second aspect of the present disclosure.
Figure 13:
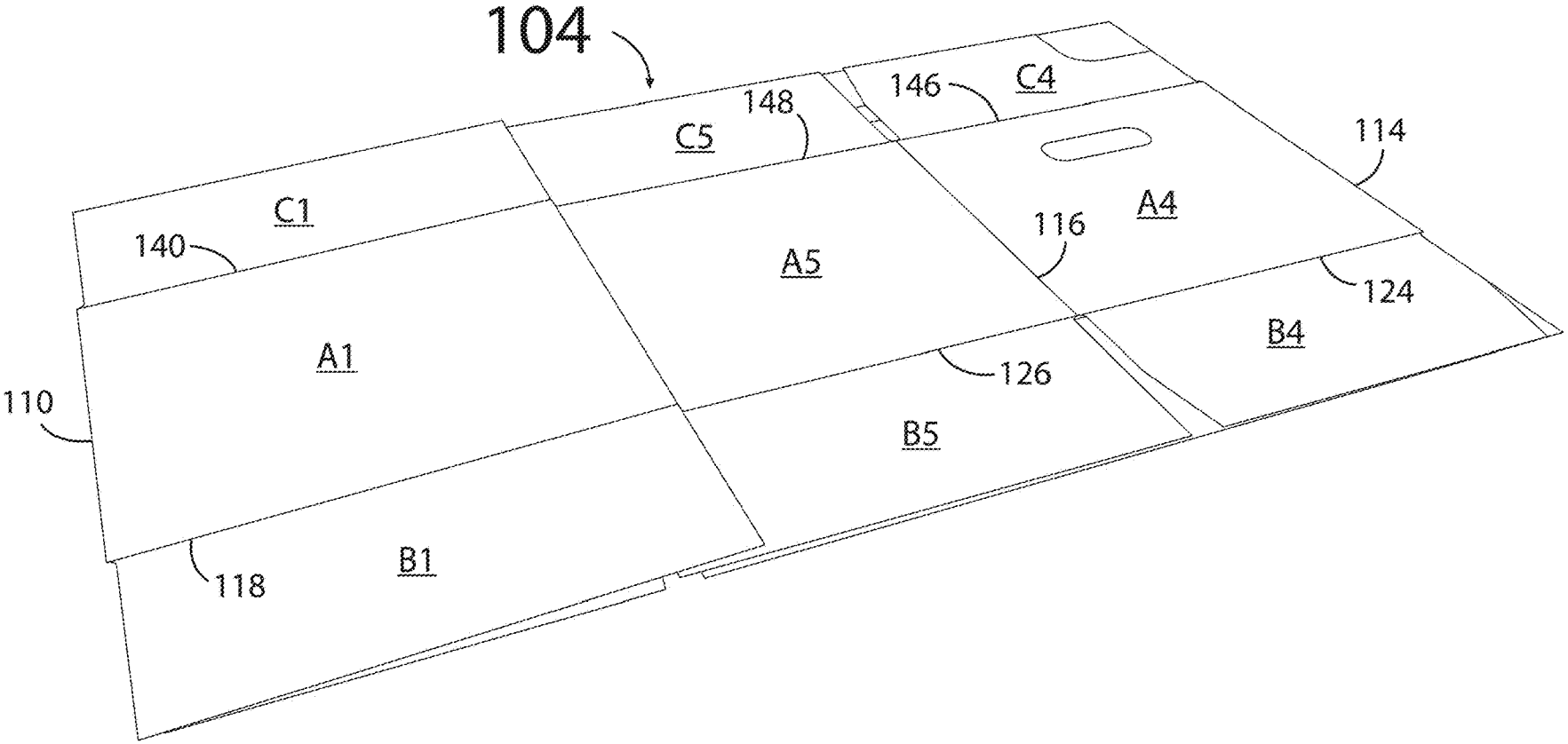
FIG. 13 is a perspective view of a preassembly according to the present disclosure.

FIG. 13 shows a preassembly 104 according to the present disclosure. FIGS. 3-8 show construction of the preassembly 104 according to a first aspect of the present disclosure, as will be discussed further below. FIGS. 9-12 show construction of the preassembly 104 according to a second aspect of the present disclosure, as will be discussed further below.

Figure 3:
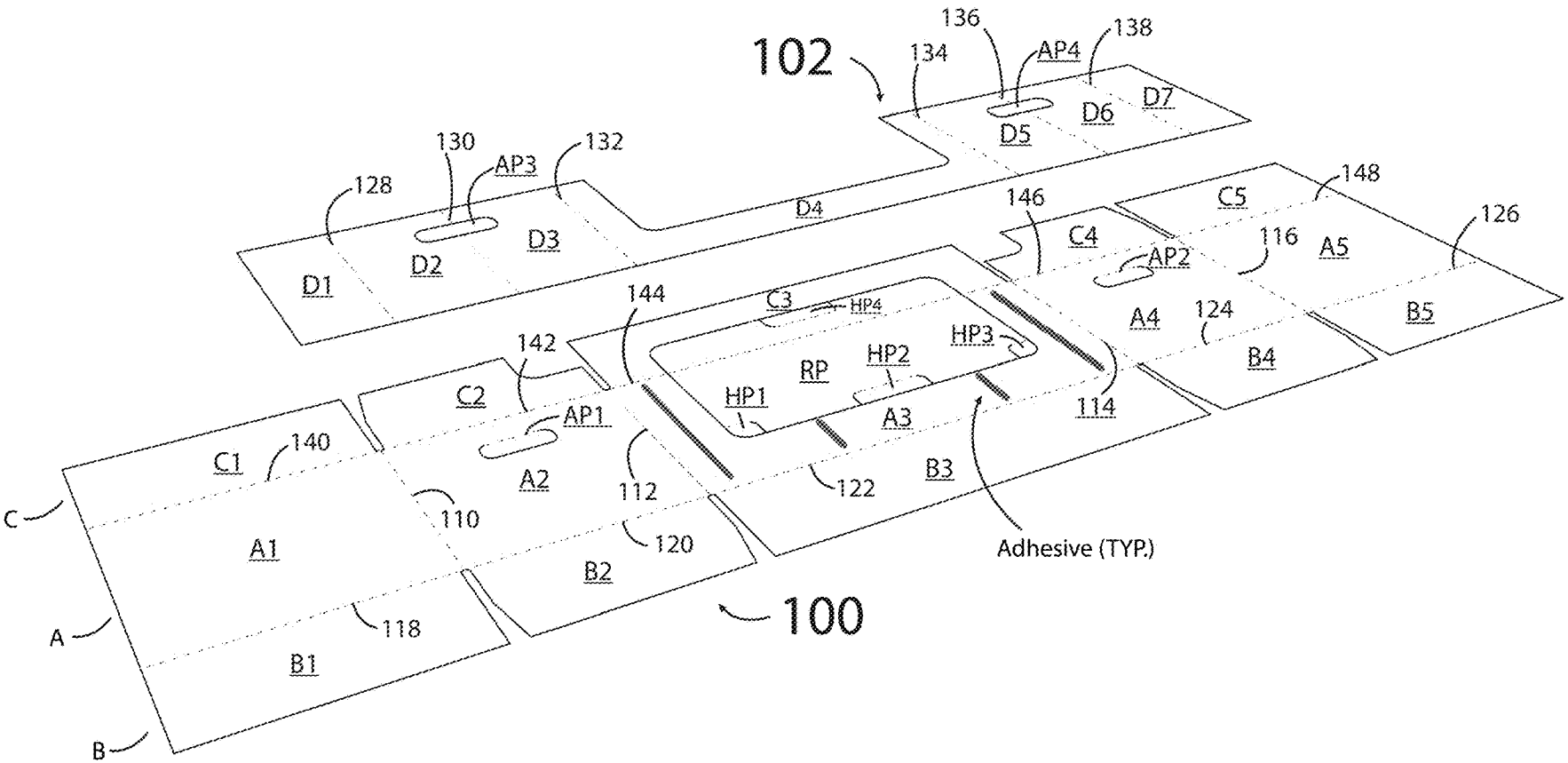
FIG. 3 is a perspective view of the primary blank including adhesive borne on portions thereof, and the secondary blank 102 disposed above the primary blank, according to a first aspect of the present disclosure.

As mentioned above, FIGS. 3-8 show construction of the preassembly 104 according to a first aspect of the present disclosure. More specifically, FIG. 3 shows adhesive applied to portions of the third section A3 of the side panel A. The adhesive is configured to adhere the third section A3 of the side panel A to the fourth panel D4 of the secondary blank 102. The adhesive may be a relatively fast setting adhesive, for example, a hot melt adhesive, or a relatively slow setting adhesive, for example a cold adhesive. FIG. 3 also shows the secondary blank 102 overlying a portion of the side panel A of the primary blank 100.

Figures 4, 4A, 4B, 4C, 4D:
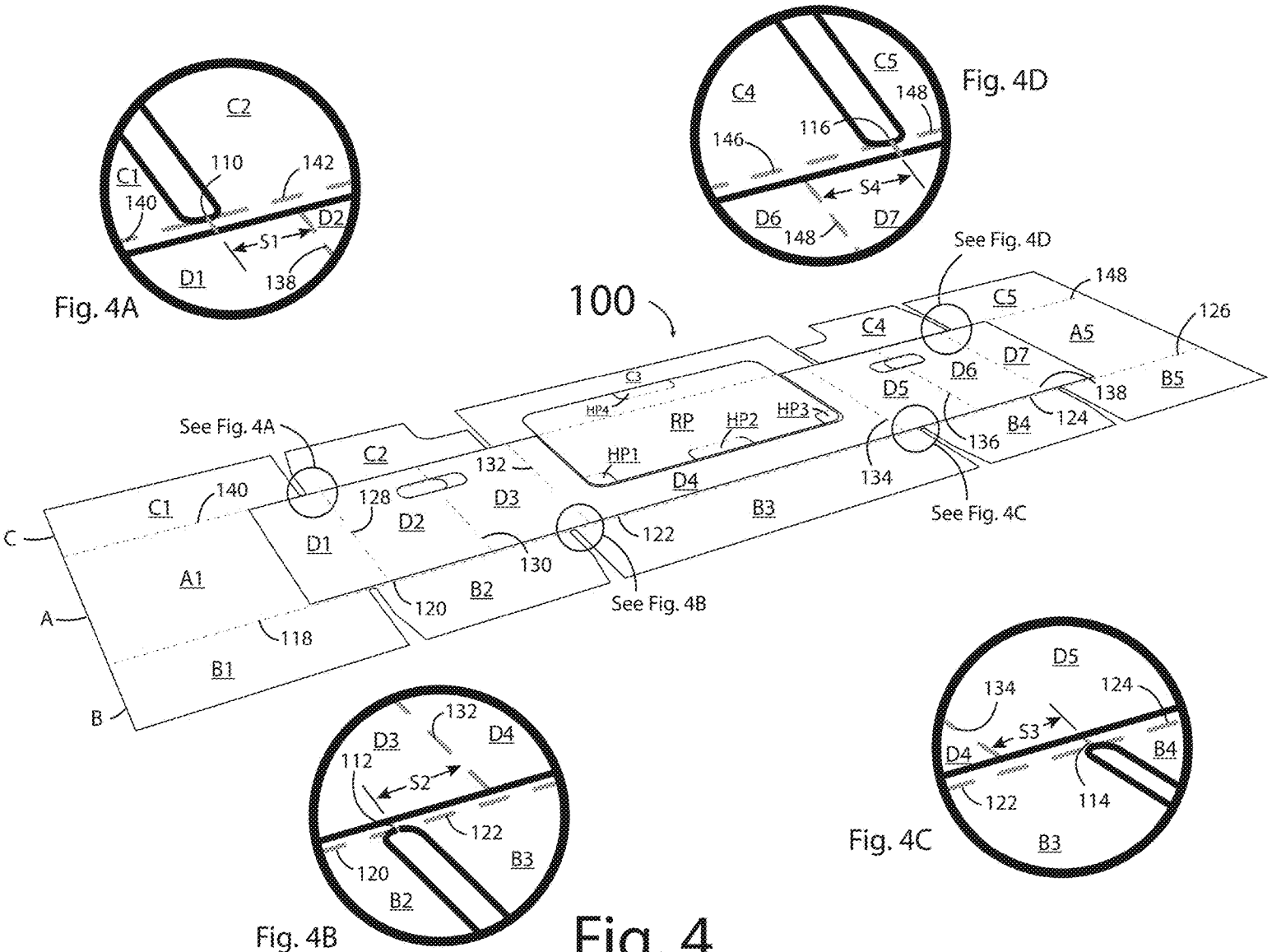
FIG. 4 is a perspective view of a combination in which a portion of the secondary blank is adhered to a corresponding portion of the primary blank.
FIG. 4A is a detail view of a portion of the combination shown in FIG. 4.
FIG. 4B is a detail view of a second portion of the combination shown in FIG. 4.
FIG. 4C is a detail view of a third portion of the combination shown in FIG. 4.
FIG. 4D is a detail view of a fourth portion of the combination shown in FIG. 4.

FIG. 4 shows a combination of the primary blank 100 and the secondary blank 102 wherein the fourth section D4 of the secondary blank 102 is adhered to the third section A3 of the primary blank 100. FIG. 4 shows the secondary blank 102 adhered to the primary blank 100 so that the secondary blank 102 is disposed between the fifth through ninth fold lines 118, 120, 122, 124, 126 and the sixteenth through twentieth fold lines 140, 142, 144, 146, 148. As such, the secondary blank 102 does not impede folding of the bottom panel B about the fifth through ninth fold lines 118, 120, 122, 124, 126, and the secondary blank 102 does not impede folding of the top panel C about the sixteenth through twentieth fold lines 140, 142, 144, 146, 148.

FIG. 4 also shows: (a) the first section D1 of the secondary blank 102 overlying the first and second sections A1, A2 of the side panel A of the primary blank 100; (b) the second section D2 of the secondary blank 102 overlying the second section A2 of the side panel A of the primary blank 100; (c) the third section D3 of the secondary blank 102 overlying the second and third sections A2, A3 of the side panel A of the primary blank 100; (d) the fifth section D5 of the secondary blank 102 overlying the third and fourth sections A3, A4 of the side panel A of the primary blank 100; (e) the sixth section D6 of the secondary blank 102 overlying the fourth section A4 of the side panel A of the primary blank 100; and (f) the seventh section D7 of the secondary blank 102 overlying the fourth and fifth sections A4, A5 of the primary blank 100. FIG. 4 further shows the third aperture AP3 overlying and laterally offset from the first aperture AP1 in a direction parallel to the fifth fold line 118. FIG. 4 still further shows the fourth aperture AP4 overlying and laterally offset from the first aperture AP2 in a direction parallel to the fifth fold line 118.

As shown in FIG. 4 and better shown in FIG. 4A, the tenth fold line 128 connecting the first and second sections D1, D2 of the secondary blank 102 to each other is laterally offset from the first fold line 110 connecting the first and second sections A1, A2 of the side panel A to each other by a first distance S1. The tenth fold line 128 overlies the section A2 of the side panel A proximate the first fold line 110.

As shown in FIG. 4 and better shown in FIG. 4B, the twelfth fold line 132 connecting the third and fourth sections D3, D4 of the secondary blank 102 to each other is laterally offset from the second fold line 112 connecting the second and third sections A2, A3 of the side panel A to each other by a second distance S2. The twelfth fold line 132 overlies the third section A3 of the side panel A proximate the second fold line 112.

As shown in FIG. 4 and better shown in FIG. 4C, the thirteenth fold line 134 connecting the fourth and fifth sections D4, D5 of the secondary blank 102 to each other is laterally offset from the third fold line 114 connecting the third and fourth sections A3, A4 of the side panel A to each other by a third distance S3. The thirteenth fold line 134 overlies the third section A3 of the side panel A proximate the third fold line 114.

As shown in FIG. 4 and better shown in FIG. 4D, discussed above, the fifteenth fold line 138 connecting the sixth and seventh sections D6, D7 of the secondary blank 102 to each other is laterally offset from the fourth fold line 116 connecting the fourth and fifth sections A4, A5 of the side panel A to each other by a fourth distance S4. The fifteenth fold line 138 overlies the fourth section A4 of the side panel A proximate the fourth fold line 116.

As shown in the drawings, the first through fourth distances S1, S2, S3, S4 are equal. Also as shown in the drawings, the widths of the second, third, fifth, and sixth sections D2, D3, D5, D6 of the secondary blank 102 as defined by corresponding perpendicular distances between the tenth and eleventh fold lines 128, 130, the eleventh and twelfth fold lines 130, 132, the fourteenth and fifteenth fold lines 134, 136, and the fifteenth and sixteenth fold lines 136, 138 are equal. In other embodiments, any or all of the first through fourth distances S1, S2, S3, S4 may be different from any or all others of the first through fourth distances S1, S2, S3, S4. Similarly, the widths of any or all of the second, third, fifth, and sixth sections D2, D3, D5, D6 of the secondary blank 102 may be different from any or all others of the second, third, fifth, and sixth sections D2, D3, D5, D6 of the secondary blank 102.

Figure 5:
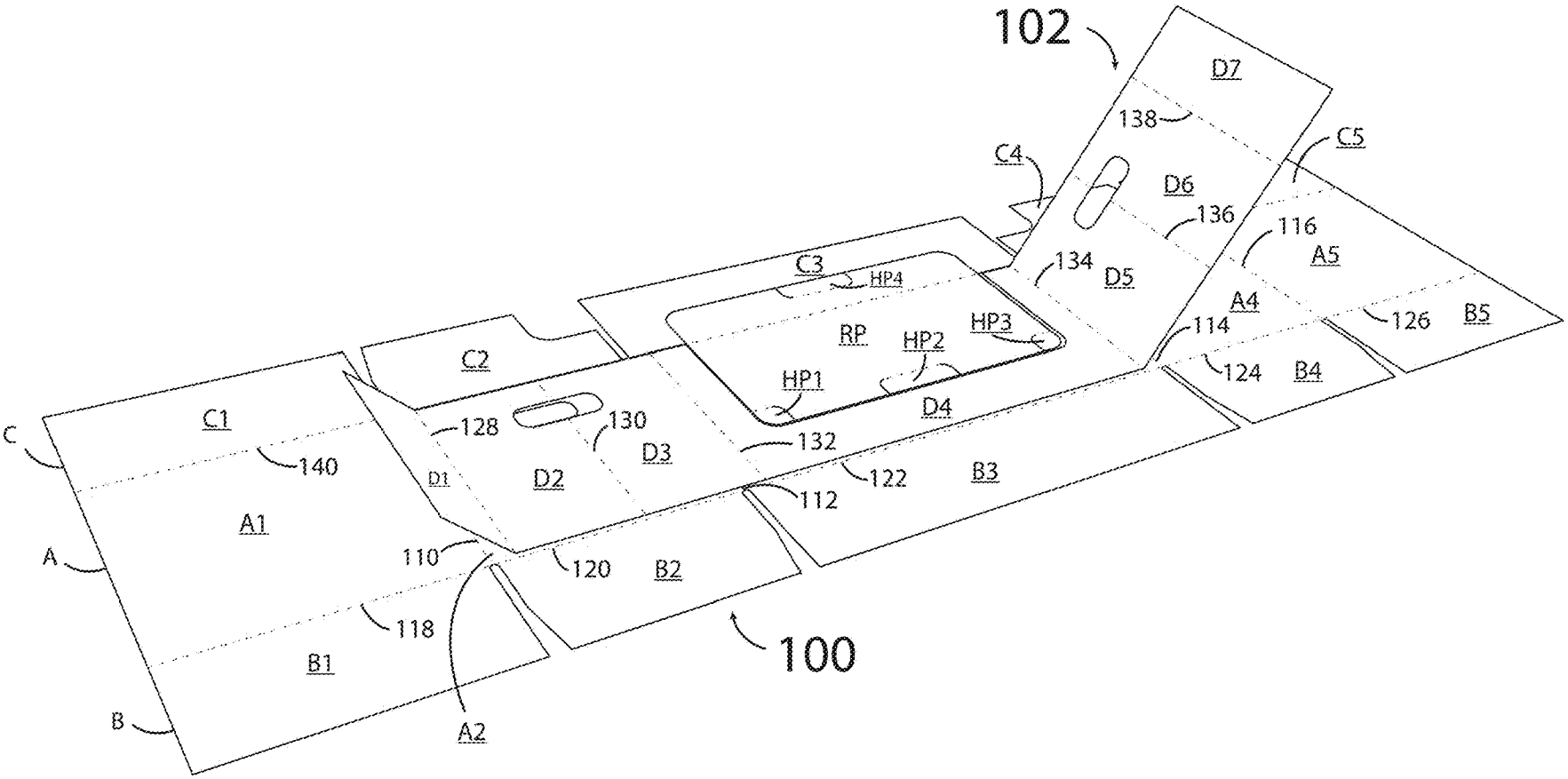
FIG. 5 is a perspective view of the combination of FIG. 4 in which the secondary blank has been manipulated according to the first aspect of the present disclosure.

FIG. 5 shows the combination of FIG. 4 being manipulated to form the preassembly of FIG. 12. More specifically, FIG. 5 shows the first section D1 of the secondary blank 102 partially folded about the tenth fold line 128 against the second section D2 of the secondary blank 102. FIG. 5 also shows the fifth section D5 of the secondary blank 102 partially folded about the thirteenth fold line 134 against the fourth section D4 of the secondary blank 102, with the sixth and seventh sections D6, D7 of the secondary blank 102 also partially folded against the fourth section D4 of the secondary blank 102.

Figure 6:
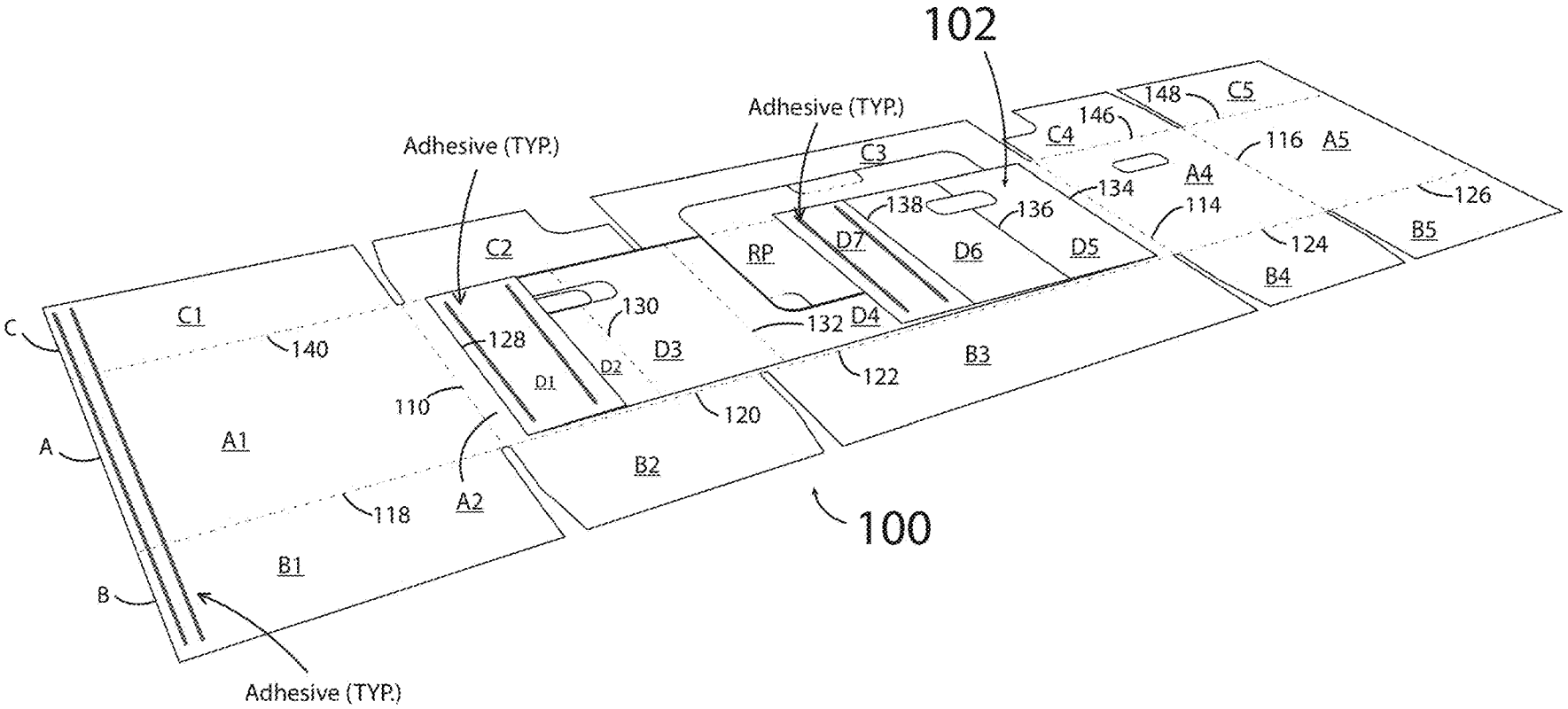
FIG. 6 is a perspective view of the combination of FIG. 5 in which the secondary blank has been further manipulated, and in which adhesive is borne on portions of the secondary blank according to the first aspect of the present disclosure.

FIG. 6 shows the combination of FIG. 4 further manipulated to form the preassembly of FIG. 12. More specifically, FIG. 6 shows the first section D1 of the secondary blank 102 folded about the tenth fold line 128 against the second section D2 of the secondary blank 102, such that an outer surface of the first section D1 of the secondary blank 102 is visible. FIG. 6 also shows the fifth section D5 of the secondary blank 102 folded about the thirteenth fold line 134 against the fourth section D4 of the secondary blank 102, with the sixth and seventh sections D6, D7 of the secondary blank 102 also against the fourth section D4 of the secondary blank 102, such that outer surfaces of the fifth, sixth, and seventh sections D5, D6, D7 of the secondary blank 102 are visible.

FIG. 6 further shows adhesive applied to portions of the outer surfaces of the first and seventh sections D1, D7 of the secondary blank 102. This adhesive is configured to adhere the first and seventh sections D1, D7 of the secondary blank 102, respectively, to the first and fifth sections A1, A5 of the side panel A of the primary blank 100. This adhesive may be a fast setting adhesive or a slow setting adhesive.

FIG. 6 still further shows adhesive applied to portions of the inner surfaces of the first sections A1, B1, C1 of the side, bottom, and top panels A, B, C, and to the respective outer surfaces of the fifth section A5, B5, C5 of the side, bottom, and top panels A, B, C. This adhesive may be a fast setting adhesive or a slow setting adhesive.

Figure 7:
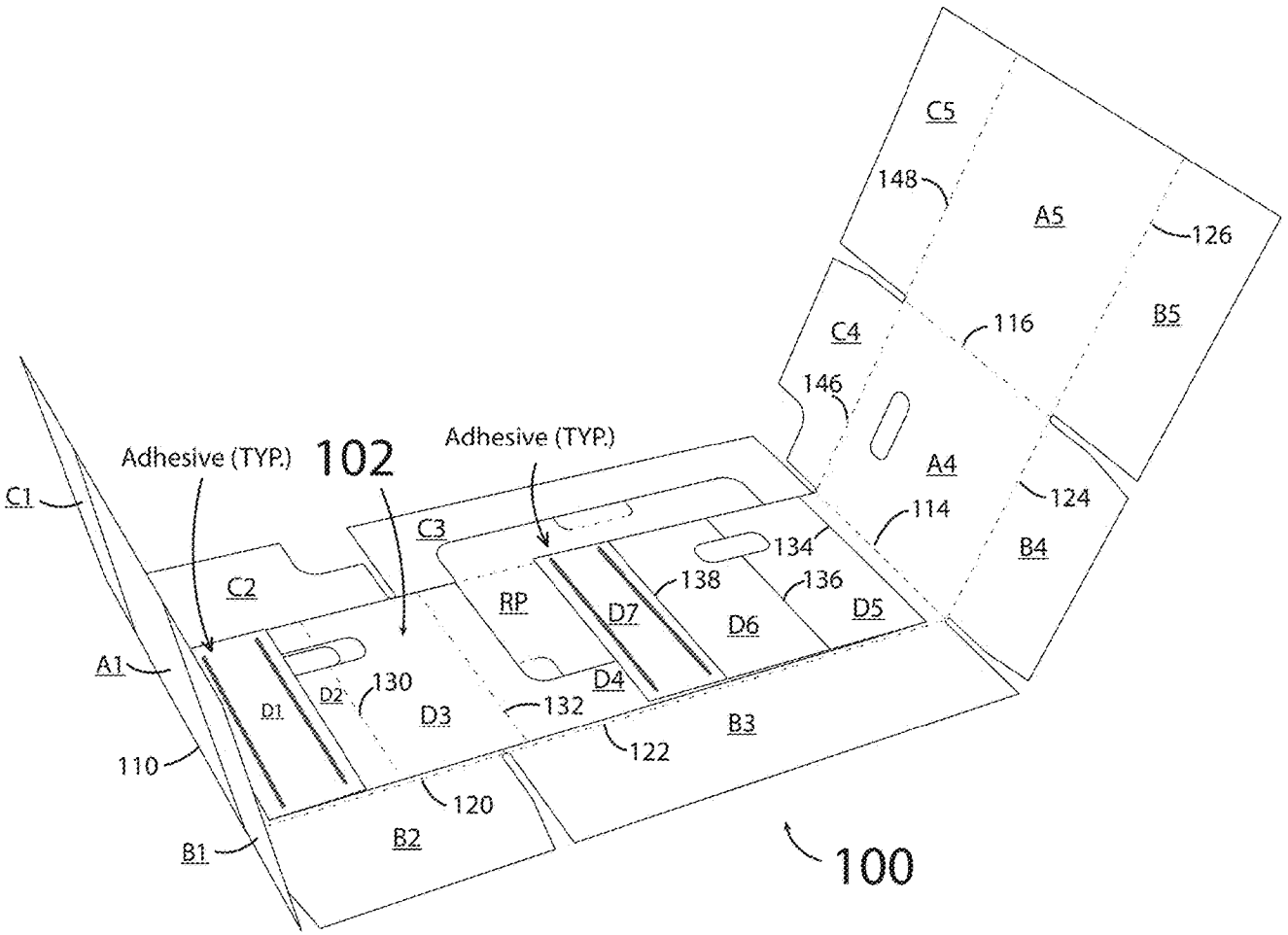
FIG. 7 is a perspective view of the combination of FIG. 6 in which the primary blank has been manipulated according to the first aspect of the present disclosure.

FIG. 7 shows the combination of FIG. 4 yet further manipulated to form the preassembly of FIG. 12. More specifically, FIG. 7 shows the fourth section A4 of the side panel A of the primary blank 100 partially folded about the fourteenth fold line 114 toward the third section A3 of the side panel A of the primary blank 100 (and the intervening fourth through seventh section D4, D5, D6, D7 of the secondary blank 102). FIG. 7 also shows the first section A1 of the side panel A of the primary blank 100 partially folded about the first fold line 110 toward the second section A2 of the side panel A of the primary blank 100 and the intervening first through third sections D1, D2, D3 of the secondary blank 102).

Figure 8:
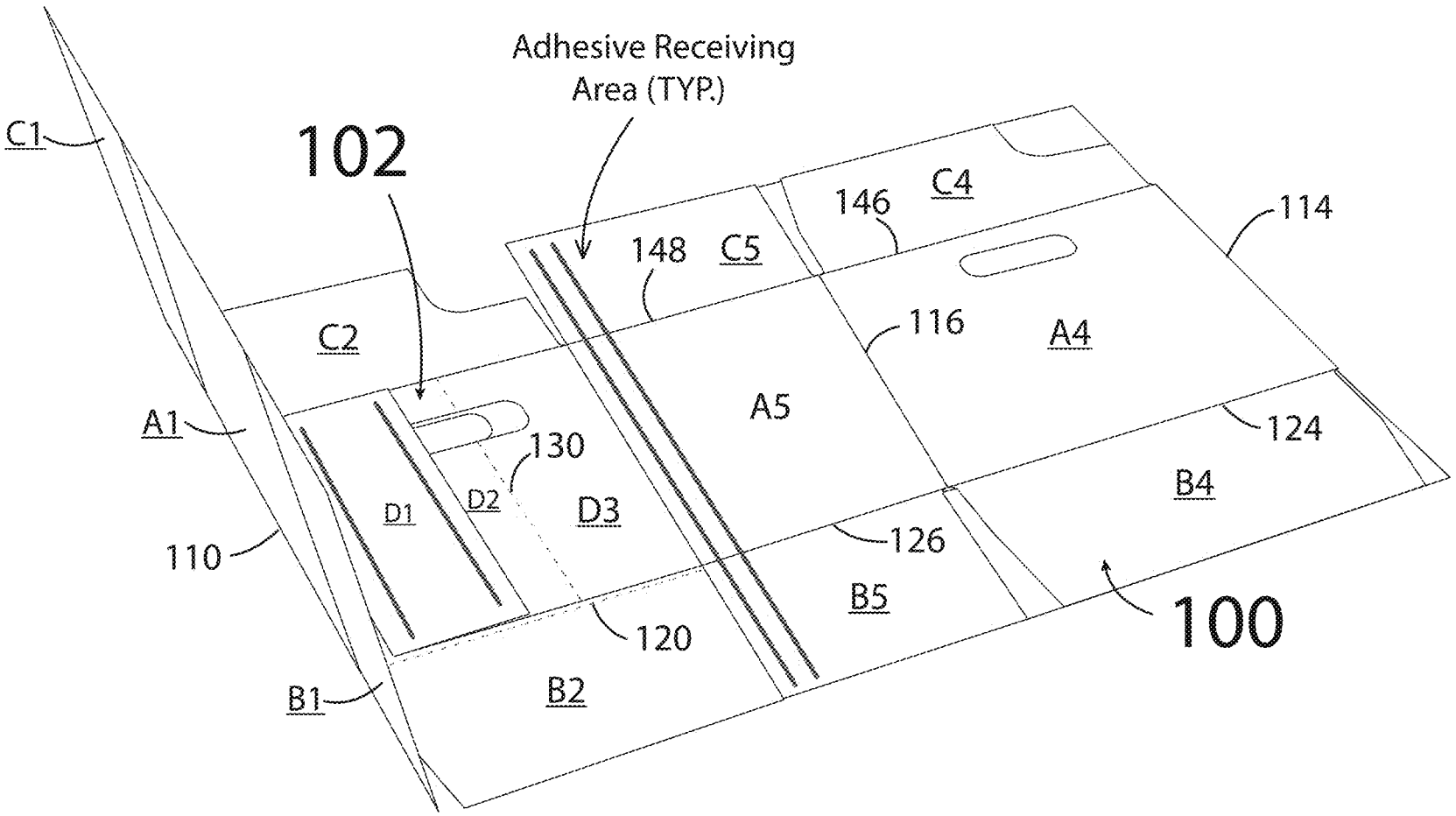
FIG. 8 is a perspective view of the combination of FIG. 7 in which the primary blank has been further manipulated according to the first aspect of the present disclosure, and in which adhesive has been applied to portions of the primary blank.

FIG. 8 shows the combination of FIG. 4 still further manipulated to form the preassembly of FIG. 12. More specifically, FIG. 8 shows the fourth section A4 of the side panel A of the primary blank 100 folded about the fourteenth fold line 114 against the third section A3 of the side panel A of the primary blank 100 (and the intervening fourth through seventh section D4, D5, D6, D7 of the secondary blank 102). So folded, the adhesive applied to the outer surface of the seventh section D7 of the secondary blank 102 contacts the inner surface of the fifth section A5 of the side panel A of the primary blank 100, thereby adhering the seventh section D7 of the secondary blank 102 to the fifth section A5 of the side panel A of the primary blank 100.

FIG. 8 also shows an adhesive receiving area defined by portions of the outer surfaces of the fifth sections A5, B5, C5 of the side, bottom, and top panels A, B, C.

FIG. 13 shows the first section A1 of the side panel A of the primary blank 100 folded against the second section A2 of the side panel A of the primary blank and against the outer surface of the first section D1 of the secondary blank 102 to form the preassembly 102. So folded, the first section A1 of the side panel A of the primary blank 100 contacts the adhesive applied to the outer surface of the first section D1 of the secondary blank 102, thereby adhering the first section A1 of the side panel A of the primary blank 100 to the first section D1 of the secondary blank 102.

Also, so folded, the adhesive applied to the inner surfaces of the first sections A1, B1, C1 of the side, bottom, and top panels A, B, C of the primary blank 100 contact the adhesive receiving area defined by the outer surfaces of the fifth sections A5, B5, C5 of the side, bottom, and top panels A, B, C of the primary blank 100, thereby adhering portions of the inner surfaces of the first sections A1, B1, C1 of the side, bottom, and top panels A, B, C of the primary blank 100 to corresponding portions of the outer surfaces of the fifth sections A5, B5, C5 of the side, bottom, and top panels A, B, C of the primary blank 100.

Figure 9:
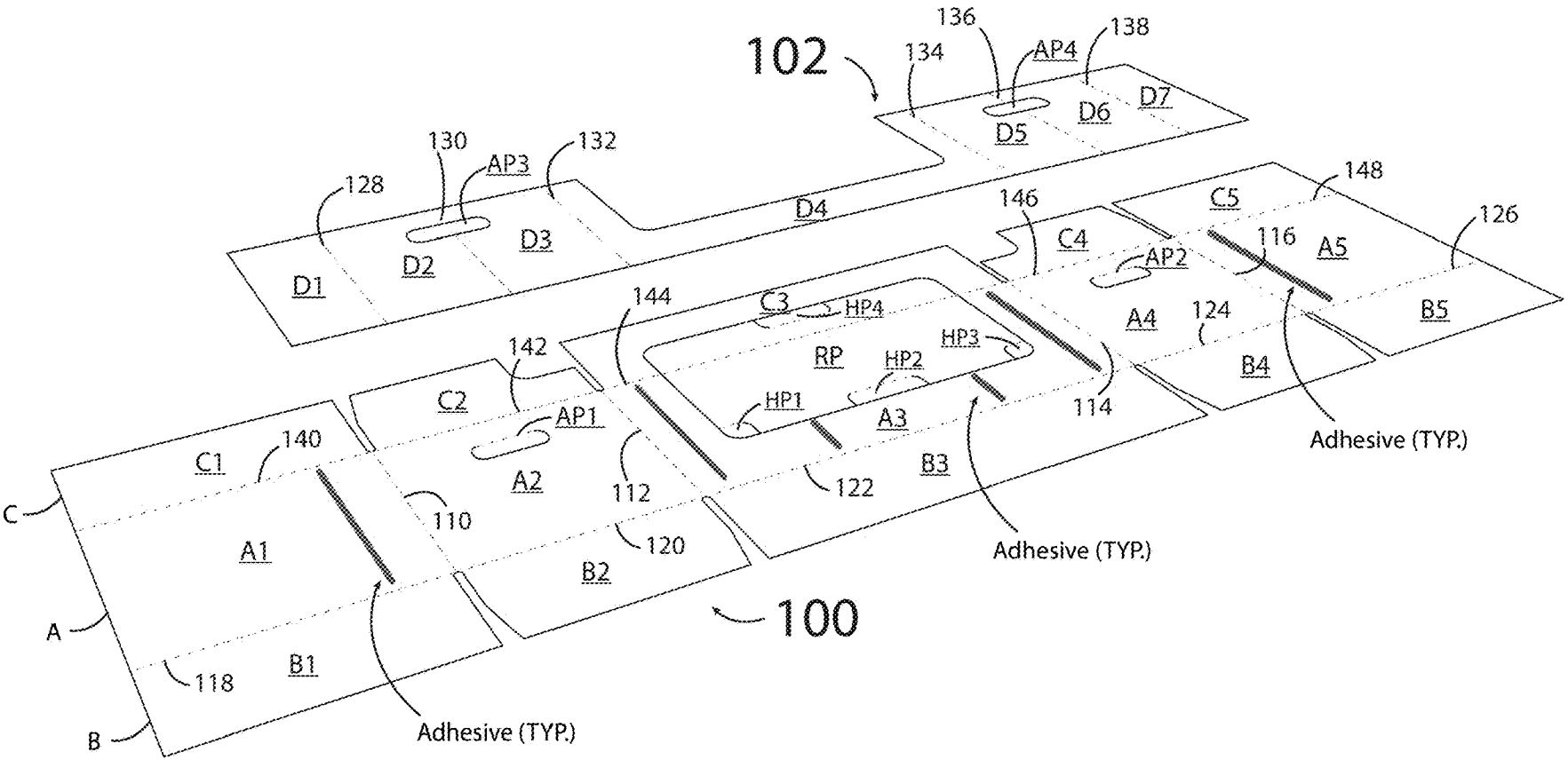
FIG. 9 is a perspective view of the primary blank including adhesive borne on portions thereof, and the secondary blank 102 disposed above the primary blank, according to a second aspect of the present disclosure.

As mentioned above, FIGS. 9-12 show construction of the preassembly 104 according to a second aspect of the present disclosure. More specifically, FIG. 9 shows adhesive applied to: (a) a portion of the first section A1 of the side panel of the primary blank 100 proximate the first fold line 110; (b) portions of the third section A3 of the side panel A; and (c) a portion of the fifth section A5 of the side panel A proximate the fourth fold line 116. FIG. 9 also shows the secondary blank 102 overlying a portion of the side panel A of the primary blank 100.

The adhesive applied to the third section A3 of the side panel A is configured to adhere the third section A3 of the side panel A to the fourth section D4 of the secondary blank 102, as will be discussed further below. The adhesive applied to the first section A1 of the side panel A is configured to adhere the first section A1 of the side panel A to the first section D1 of the secondary blank 102, as will be discussed further below. The adhesive applied to the fifth section A5 of the side panel A is configured to adhere the fifth section A5 of the side panel A to the seventh section D7 of the secondary blank 102, as will be discussed further below. The adhesive applied to the third section A3 of the side panel A is a relatively fast setting adhesive, for example, a hot melt adhesive. The adhesive applied to the first and fifth sections A1, A5 of the side panel A is a relatively slow setting adhesive, for example a cold adhesive.

Figures 10, 10A, 10B, 10C, 10D:
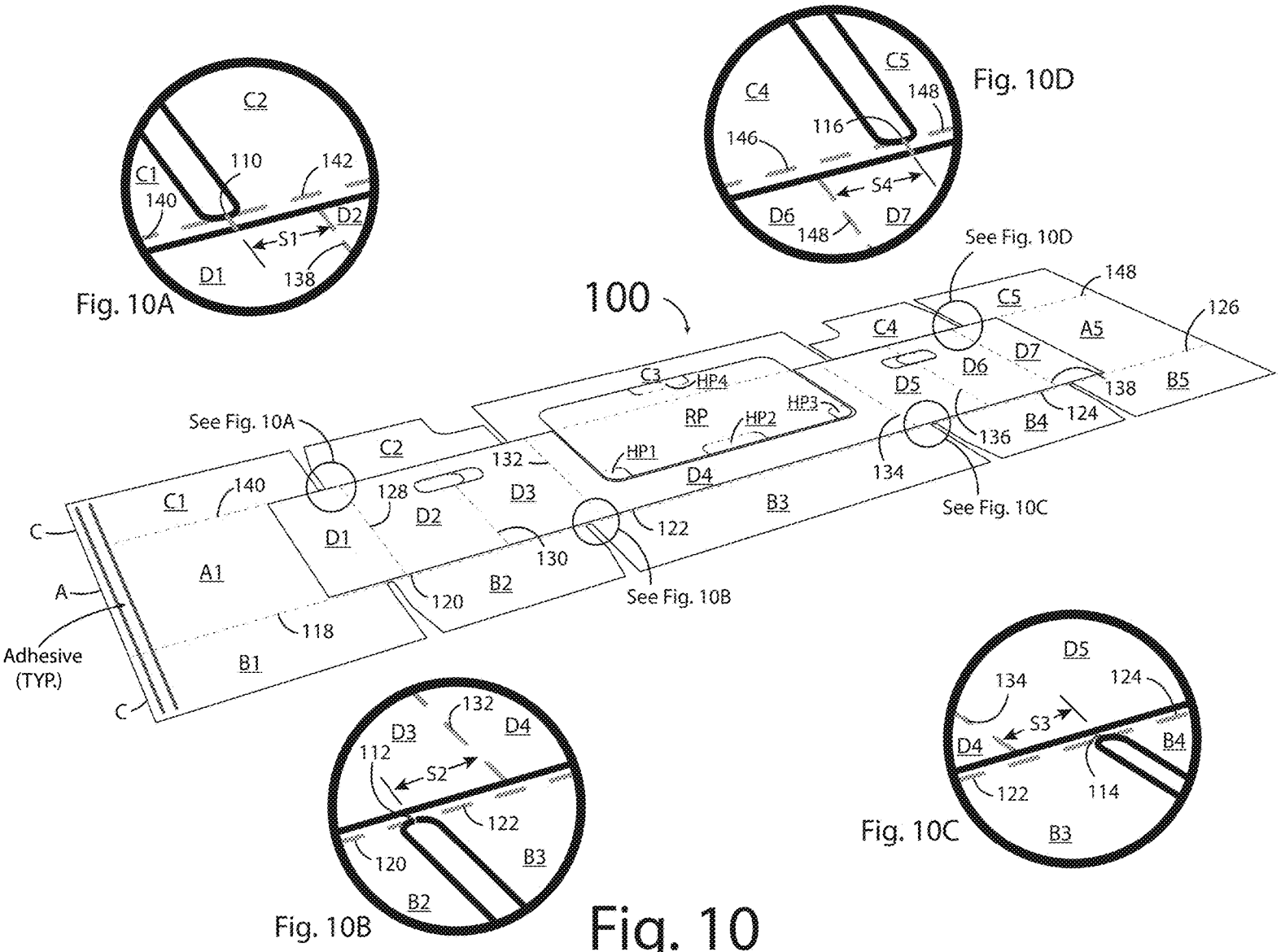
FIG. 10 is a perspective view of a combination in which a portion of the secondary blank is adhered to a corresponding portion of the primary blank according to the second aspect of the present disclosure.
FIG. 10A is a detail view of a portion of the combination shown in FIG. 10.
FIG. 10B is a detail view of a second portion of the combination shown in FIG. 10.
FIG. 10C is a detail view of a third portion of the combination shown in FIG. 10.
FIG. 10D is a detail view of a fourth portion of the combination shown in FIG. 10.

FIG. 10 shows the secondary blank 102 abutting the primary blank 102. More specifically, FIG. 10 shows the fourth section D4 of the secondary blank 102 adhered to the third section A3 of the primary blank 100 by way of the relatively fast setting adhesive applied to the third section A3 of the side panel A of the primary blank 100, as shown in FIG. 9. FIG. 10 also shows: (a) the first section D1 of the secondary blank 102 overlying the first and second sections A1, A2 of the side panel A of the primary blank 100 with the relatively slow setting adhesive therebetween; (b) the second section D2 of the secondary blank 102 overlying the second section A2 of the side panel A of the primary blank 100; (c) the third section D3 of the secondary blank 102 overlying the second and third sections A2, A3 of the side panel A of the primary blank 100; (d) the fifth section D5 of the secondary blank 102 overlying the third and fourth sections A3, A4 of the side panel A of the primary blank 100; (e) the sixth section D6 of the secondary blank 102 overlying the fourth section A4 of the side panel A of the primary blank 100; and (f) the seventh section D7 of the secondary blank 102 overlying the fourth and fifth sections A4, A5 of the primary blank 100 with the relatively slow setting adhesive therebetween. FIG. 10 further shows the third aperture AP3 overlying and laterally offset from the first aperture AP1 in a direction parallel to the fifth fold line 118. FIG. 10 still further shows the fourth aperture AP4 overlying and laterally offset from the first aperture AP2 in a direction parallel to the fifth fold line 118.

As shown in FIG. 10 and better shown in FIG. 10A, the tenth fold line 128 connecting the first and second sections D1, D2 of the secondary blank 102 to each other is laterally offset from the first fold line 110 connecting the first and second sections A1, A2 of the side panel A to each other by a first distance S1. The tenth fold line 128 overlies the section A2 of the side panel A proximate the first fold line 110.

As shown in FIG. 10 and better shown in FIG. 10B, the twelfth fold line 132 connecting the third and fourth sections D3, D4 of the secondary blank 102 to each other is laterally offset from the second fold line 112 connecting the second and third sections A2, A3 of the side panel A to each other by a second distance S2. The twelfth fold line 132 overlies the third section A3 of the side panel A proximate the second fold line 112.

As shown in FIG. 10 and better shown in FIG. 10C, the thirteenth fold line 134 connecting the fourth and fifth sections D4, D5 of the secondary blank 102 to each other is laterally offset from the third fold line 114 connecting the third and fourth sections A3, A4 of the side panel A to each other by a third distance S3. The thirteenth fold line 134 overlies the third section A3 of the side panel A proximate the third fold line 114.

As shown in FIG. 10 and better shown in FIG. 10D, discussed above, the fifteenth fold line 138 connecting the sixth and seventh sections D6, D7 of the secondary blank 102 to each other is laterally offset from the fourth fold line 116 connecting the fourth and fifth sections A4, A5 of the side panel A to each other by a fourth distance S4. The fifteenth fold line 138 overlies the fourth section A4 of the side panel A proximate the fourth fold line 116.

Figure 11:
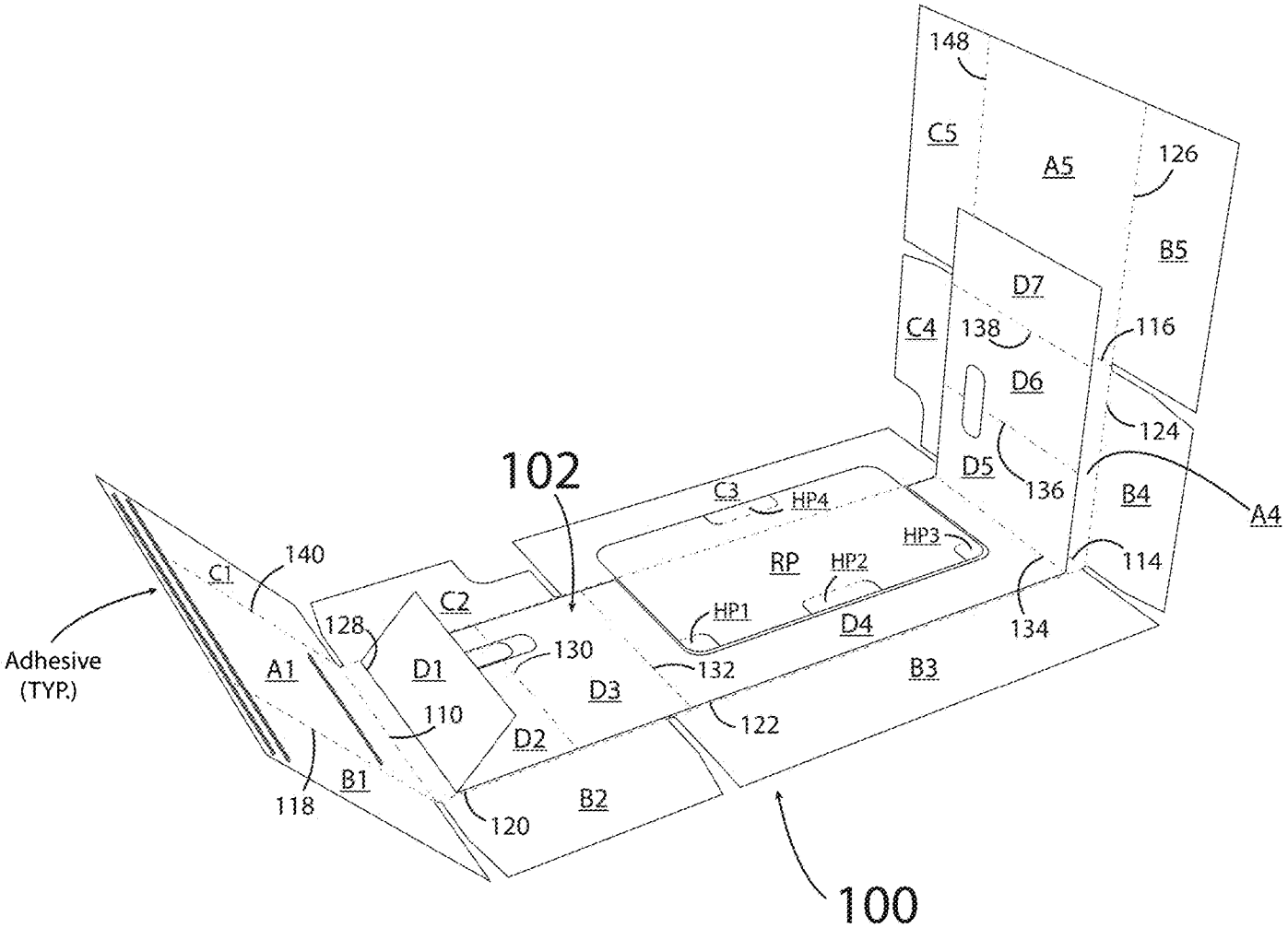
FIG. 11 is a perspective view of the combination of FIG. 10 in which the primary and secondary blanks have been manipulated according to the second aspect of the present disclosure.

FIG. 11 shows the primary blank 100 being manipulated to form the preassembly 102 from the combination shown in FIG. 10. More specifically, FIG. 11 shows the first section A1 of the primary blank 100 partially folded toward the second section A2 of the primary blank 100 (and toward the intervening first, second, and third sections D1, D2, D3 of the secondary blank 102) along the first fold line 110. FIG. 11 also shows the first section D1 of the secondary blank 102 partially folded about the tenth fold line 128 against the second section D2 of the secondary blank 102. In FIG. 11, the first section D1 of the secondary blank 102 is shown as being displaced from the first section A1 of the side panel A of the primary blank 100 for clarity. In practice, however, the first section D1 of the secondary blank 102 typically would become folded about the tenth fold line 128 against the second section D2 of the secondary blank 102 as the result of the first section A1 of the side panel A being folded about the first fold line 110, thereby forcing the first section D1 of the secondary blank 102 to be folded about the tenth fold line 128 through interaction with the first section A1 of the side panel A. In the course of this manipulation, the relatively slow setting adhesive applied to the inner surface of the first section A1 of the side panel of the primary blank 100 smears against the corresponding outer surface of the first section D1 of the secondary blank 102.

FIG. 11 also shows the fourth section A4 of the side panel A (along with the fifth section A5 of the side panel A) of the primary blank 100 being folded about the third fold line 114, thereby causing the fifth section D5 (along with the sixth and seventh sections D6, D7) of the secondary blank to fold about the eighteenth fold line 144. Such folding of the fourth section A4 of the side panel A of the primary blank 100 and the fifth section D5 of the secondary panel 102 causes the adhesive applied to the fifth section A5 of the side panel A to smear against the seventh section D7 of the secondary blank.

FIG. 12 shows the combination of FIG. 4 still further manipulated to form the preassembly of FIG. 12. More specifically, FIG. 12 shows the fourth section A4 of the side panel A of the primary blank 100 folded about the fourteenth fold line 114 against the third section A3 of the side panel A of the primary blank 100 (and the intervening fourth through seventh section D4, D5, D6, D7 of the secondary blank 102). So folded, the adhesive applied to the outer surface of the seventh section D7 of the secondary blank 102 contacts the inner surface of the fifth section A5 of the side panel A of the primary blank 100, thereby adhering the seventh section D7 of the secondary blank 102 to the fifth section A5 of the side panel A of the primary blank 100.

FIG. 8 also shows an adhesive receiving area defined by portions of the outer surfaces of the fifth sections A5, B5, C5 of the side, bottom, and top panels A, B, C.

FIG. 13 shows the first section A1 of the side panel A of the primary blank 100 folded against the second section A2 of the side panel A of the primary blank and against the outer surface of the first section D1 of the secondary blank 102. So folded, the adhesive applied to the outer surface of the first section D1 of the secondary blank 102 adheres the first section A1 of the side panel A of the primary blank 100 to the first section D1 of the secondary blank 102.

Also, so folded, the adhesive applied to the inner surfaces of the first sections A1, B1, C1 of the side, bottom, and top panels A, B, C of the primary blank 100 contact the adhesive receiving area defined by the outer surfaces of the fifth sections A5, B5, C5 of the side, bottom, and top panels A, B, C of the primary blank 100, thereby adhering portions of the inner surfaces of the first sections A1, B1, C1 of the side, bottom, and top panels A, B, C of the primary blank 100 to corresponding portions of the outer surfaces of the fifth sections A5, B5, C5 of the side, bottom, and top panels A, B, C of the primary blank 100.

The foregoing discussions of the first and second aspects of the disclosure identify certain locations where adhesive is applied to the primary blank 100 and the secondary blank 102. In embodiments, any or all such adhesives could instead be applied to the corresponding adhesive receiving areas.

FIGS. 14-17 show erection of a container 106 from the preassembly 104 according to the present disclosure.

Figure 14:
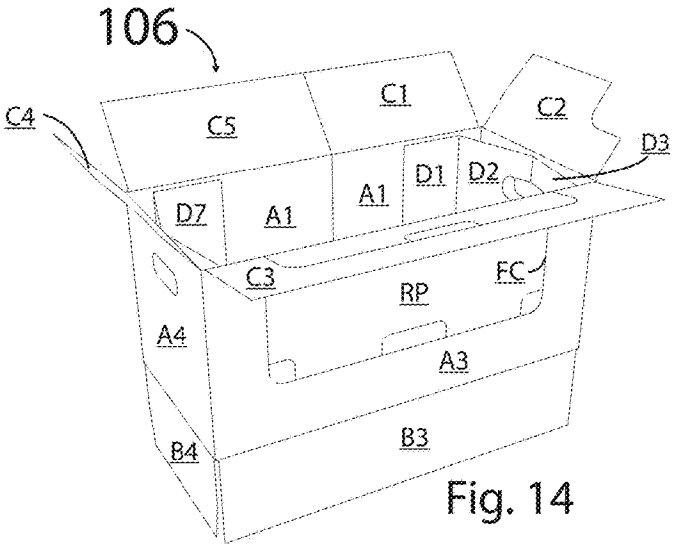
FIG. 14 is a perspective view of the preassembly of FIG. 13 partially erected into a container.
Figure 15:
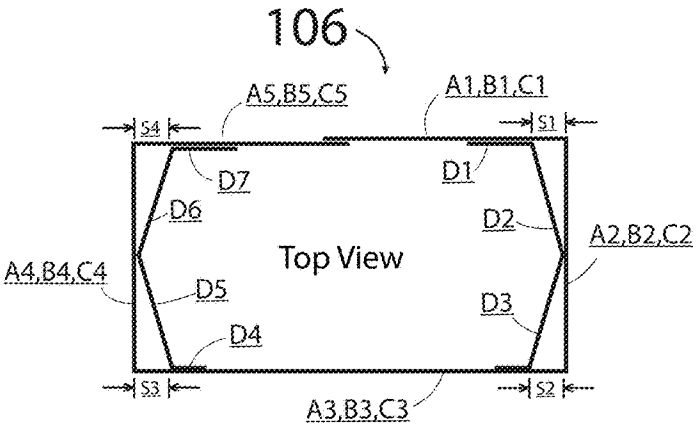
FIG. 15 is a top plan view of the partially erected container shown in FIG. 14.

With reference to FIG. 14, the container 106 may be partially erected from the preassembly 104 by manipulating the primary blank 100 as follows. The first section A1 of the side panel A is folded away from the second section A2 of the side panel A along the first fold line 110 to a position perpendicular to the second section A2 of the side panel A. The second section A2 of the side panel A is folded toward the third section A3 of the side panel A along the second fold line 112 to a position perpendicular to the third section A3 of the side panel A. The third section A3 of the side panel is folded away from the fourth section A4 of the side panel A along the third fold line 114 to a position perpendicular to the fourth section A4 of the side panel A. The fourth section A4 of the side panel A is folded toward the fifth section A5 of the side panel A along the fourth fold line 116 to a position perpendicular to the fifth section A5 of the side panel A.

Based on the adherence of the first section A1 of the side panel A of the primary blank 100 to the first section D1 of the secondary blank 102, the adherence of the third section A3 of the side panel A of the primary blank 100 to the fourth section D4 of the secondary blank 102, and the adherence of the fifth section A5 of the side panel A of the primary blank 100 to the seventh section D7 of the secondary blank 102, the foregoing manipulation of the primary blank 100 causes: (a) the first section D1 of the secondary blank 102 to fold away from the second section D2 of the secondary blank 102 about the tenth fold line 128; (b) the third section D3 of the secondary blank 102 to fold toward the fourth section D4 of the secondary blank; (c) the fourth section D4 of the secondary blank 102 to fold away from the fifth section D5 of the secondary blank 102; and (d) the sixth section D6 of the secondary blank 102 to fold toward the seventh section D7 of the secondary blank 102.

The foregoing folding of the sections D1, D2, D3, D4, D5, D6, D7 of the secondary blank 102 away from or toward each other shortens the perpendicular distance between the tenth and fifteenth fold lines 128, 132, thereby creating a compressive force pushing the second and third sections D2, D3 of the secondary blank 102 toward each other. This compressive force causes the second section D2 of the secondary blank to fold toward the third section D3 of the secondary blank 102 along the eleventh fold line 130, thereby forming first and second corner supports CS1, CS2. Similarly, the foregoing folding of the sections D1, D2, D3, D4, D5, D6, D7 of the secondary blank 102 away from or toward each other shortens the perpendicular distance between the thirteenth and fifteenth fold lines 134, 138, thereby creating a compressive force pushing the fifth and sixth sections D5, D6 of the secondary blank 102 toward each other. This compressive force causes the fifth section D5 of the secondary blank to fold toward the sixth section D6 of the secondary blank 102 along the fourteenth fold line 136, thereby forming third and fourth corner supports CS3, CS4.

The extent to which the foregoing sections D1, D2, D3, D4, D5, D6, D7 of the secondary blank 102 fold away from or toward each other is a function of the first, second, third, and fourth distances S1, S2, S3, S4. The greater the magnitude of the first, second, third, and fourth distances S1, S2, S3, S4, the further the corresponding sections D1, D2, D3, D4, D5, D6, D7 of the secondary blank 102 fold away from or toward each other. Similarly, the shapes of the corner supports CS1, CS2, CS3, CS4 are functions of the first, second, third, and fourth distances S1, S2, S3, S4. The greater the magnitude of the first, second, third, and fourth distances S1, S2, S3, S4, the further the respective corner supports extend away from corresponding ones of the second and fourth sections A2, A4 of the side panel A of the primary blank 100.

Figure 16:
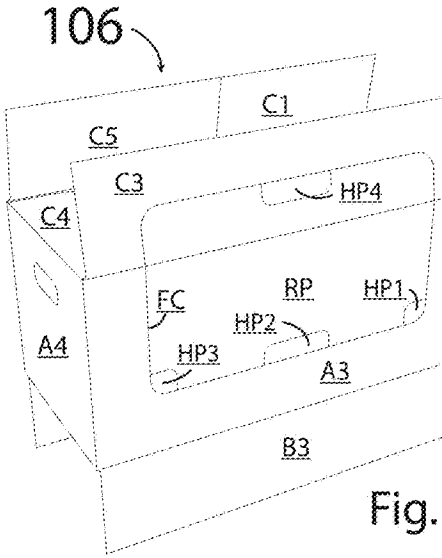
FIG. 16 is a perspective view of the preassembly of FIG. 13 further erected into a container.

FIG. 16 shows the second section B2 of the bottom panel B and the second section C2 of the top panel C of the primary blank 100 manipulated to positions perpendicular to the second section A2 of the side panel A of the primary blank 100. Not visible in FIG. 14 is similar manipulation of fourth section B4 of the bottom panel B and the fourth section C4 of the top panel C of the primary blank 100 to positions perpendicular to the fourth side panel A4 of the primary blank 100.

Figure 17:
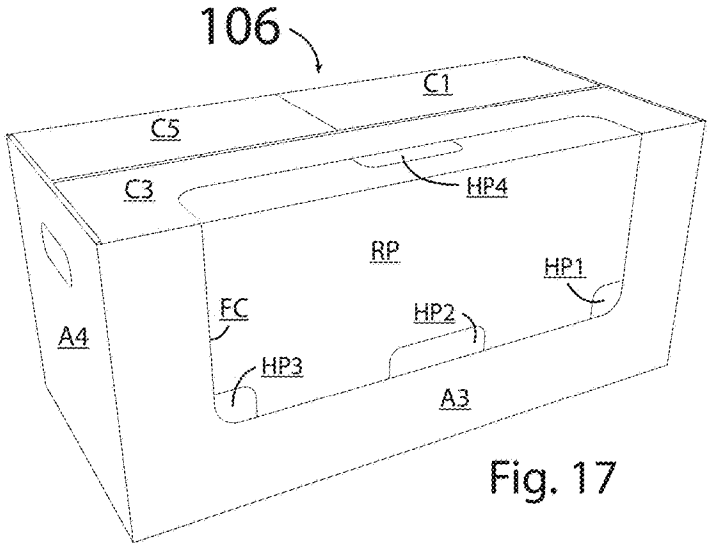
FIG. 17 is a perspective view of a container formed from the preassembly of FIG. 13.

FIG. 17 shows the first, third, and fifth sections B1, B3, B5 of the bottom panel B and the first, third, and fifth sections C1, C3, C5 of the top panel C2 of the primary blank 100 manipulated to positions perpendicular to the first, third, and fifth sections A1, A3, A5 of the side panel A of the primary blank 100.

In use, the removable panel RP may be removed, for example, by inserting a finger or fingers through any one or more of the hinged panels HP1, HP2, HP3, HP4 and pulling the removable panel RP away from the third side and third top sections A3, B3 of the primary blank 100, thereby tearing breaking the frangible connection FC. As suggested above, another container can be stacked atop the container 104 and be supported by the internal corner supports CS1, CS2, CS3, CS4.

The invention claimed is:

1. A combination for a retail ready container, the combination comprising:

a primary blank comprising a side panel and a bottom panel, the side panel comprising:

a first section;

a second section connected to the first section along a first fold line;

a third section connected to the second section along a second fold line parallel to the first fold line;

a fourth section connected to the third section along a third fold line parallel to the first fold line; and a fifth section connected to the fourth section along a fourth fold line parallel to the first fold line; and the bottom panel comprising:

a first section connected to first section of the side panel along a fifth fold line perpendicular to the first fold line;

a second section connected to second section of the side panel along a sixth fold line collinear with the fifth fold line;

a third section connected to third section of the side panel along a seventh fold line collinear with the fifth fold line;

a fourth section connected to the fourth section of the side panel along an eighth fold line collinear with the fifth fold line; and a fifth section connected to the fifth section of the side panel along a ninth fold line collinear with the fifth fold line;

a secondary blank comprising:

a first section;

a second section connected to the first section along a tenth fold line;

a third section connected to the second section along an eleventh fold line parallel to the tenth fold line;

a fourth section connected to the third section along a twelfth fold line parallel to the tenth fold line; and a fifth section connected to the fourth section along an thirteenth fold line parallel to the tenth fold line;

a sixth section connected to the fifth section along a fourteenth fold line parallel to the tenth fold line; and a seventh section connected to the fifth section along a fifteenth fold line parallel to the tenth fold line;

wherein the fourth section of the secondary blank is adhered to the third section of the primary blank so that:

the tenth fold line is parallel to and spaced from the first fold line toward the second fold line by a first distance;

the twelfth fold line is parallel to and spaced from the second fold line toward the third fold line by a second distance;

the thirteenth fold line is parallel to and spaced from the third fold line toward the second fold line by a third distance; and the fifteenth fold line is parallel to and spaced from the fourth fold line toward the third fold line by a fourth distance;

wherein the combination is configured so that first section of the secondary blank is foldable along the tenth fold line against the second section of the secondary blank and the first section of the side panel of the primary blank is foldable about the first fold line to enable adhesive connection of the first section of the side panel of the primary blank to the first section of the secondary blank, and wherein the combination is configured so that fifth section of the secondary blank is foldable along the thirteenth fold line against the fourth section of the secondary blank and the fourth section of the side panel of the primary blank is foldable about the third fold line to enable adhesive connection of the fifth section of the side panel of the primary blank to the seventh section of the secondary blank, so that the combination may be manipulated between a flat configuration and an erected configuration with the first section of the side panel of the primary blank adhesively connected to the first section of the secondary blank and with the fifth section of the side panel of the primary blank adhesively connected to the seventh section of the secondary blank.

2. The combination of claim 1 wherein:

the primary blank further comprises a removable portion frangibly connected to the third section of the side panel, and the fourth section of the secondary blank defines a cutout having a shape complementary to a shape of the removable portion.

3. The combination of claim 1 wherein the primary blank further comprises a top panel comprising:

a first section connected to first section of the side panel along a sixteenth fold line perpendicular to the first fold line;

a second section connected to second section of the side panel along a seventeenth fold line collinear with the sixteenth fold line;

a third section connected to third section of the side panel along an eighteenth fold line collinear with the sixteenth fold line;

a fourth section connected to the fourth section of the side panel along a nineteenth fold line collinear with the sixteenth fold line; and a fifth section connected to the fifth section of the side panel along a twentieth fold line collinear with the sixteenth fold line.

4. The combination of claim 1 wherein:

the primary blank further comprises a removable portion having a first portion frangibly connected to the third section of the side panel and a second portion frangibly connected to the third section of the top panel, and the fourth section of the secondary blank defines a cutout having a shape complementary to a shape of the portion of the removable portion frangibly connected to the third section of the side panel.

5. A preassembly formed from the combination of claim 1 wherein:

the fifth section of the secondary blank is folded along the thirteenth fold line against the fourth section of the secondary blank; and the first section of the secondary blank is folded along the tenth fold line against the second section of the secondary blank.

6. The preassembly of claim 5 wherein:

the fourth section of the side panel of the primary blank is folded along the third fold line against the fifth section of the secondary blank; and the first section of the side panel is folded along the first fold line against the second section of the side panel and intervening portions of the secondary blank.

7. The preassembly of claim 6 wherein:

the first section of the side panel of the primary blank is adhered to the first section of the secondary blank;

the fifth section of the side panel of the primary blank is adhered to the seventh section of the of the secondary blank; and the first sections of the side, bottom, and top panels of the primary blank are adhered, respectively, to the fifth sections of the side, bottom, and top panels of the primary blank.

8. A container formed from the preassembly of claim 7 wherein:

the first section of the side panel of the primary substrate is folded about the first fold line to a position perpendicular to the second section of the side panel of the primary substrate;

the second section of the side panel of the primary substrate is folded about the second fold line to a position perpendicular to the third section of the side panel of the primary substrate;

the third section of the side panel of the primary substrate is folded about the third fold line to a position perpendicular to the fourth section of the side panel of the primary substrate; and the fifth section of the side panel of the primary substrate is folded about the fourth fold line to a position perpendicular to the fourth section of the side panel of the primary substrate.

9. The container of claim 8 wherein:

the first section of the secondary blank is folded along the tenth fold line with respect to the second section of the secondary blank, the second section of the secondary blank is folded along the eleventh fold line with respect to the third section of the secondary blank, the third section of the secondary blank is folded along the twelfth fold line with respect to the fourth section of the secondary blank, the fourth section of the secondary blank is folded along the thirteenth fold line with respect to the fifth section of the secondary blank, the fifth section of the secondary blank is folded along the fourteenth fold line with respect to the sixth section of the secondary blank, and the sixth section of the secondary blank is folded along the fifteenth fold line with respect to the seventh section of the secondary blank.

10. The container of claim 9 wherein:

the tenth fold line is adjacent or abuts the first section of the side panel of the primary blank, and the eleventh fold line is adjacent or abuts the second section of the side panel of the primary blank.

11. The container of claim 10, wherein the tenth fold line is parallel to the second section of the side panel of the primary blank and is spaced from the second section of the side panel of the primary blank by a first distance.

12. The container of claim 11, wherein the twelfth fold line is adjacent or abuts the third section of the side panel of the primary blank.

13. The container of claim 12, wherein the twelfth fold line is parallel to the second section of the side panel of the primary blank and is spaced from the second section of the side panel of the primary blank by a second distance.

14. The container of claim 13, wherein the thirteenth fold line is adjacent or abuts the third section of the side panel, and the fourteenth fold line is adjacent or abuts the fourth section of the side panel.

15. The container of claim 14, wherein the thirteenth fold line is parallel to the fourth section of the side panel of the primary blank and is spaced from the fourth section of the side panel of the primary blank by a third distance.

16. The container of claim 15, wherein the fifteenth fold line is adjacent or abuts the fifth section of the side panel of the primary blank.

17. The container of claim 16, wherein the fifteenth fold line is parallel to the fourth section of the side panel of the primary blank and is spaced from the fourth section of the side panel of the primary blank by a fourth distance.

18. The container of claim 17, wherein the second section of the secondary blank panel cooperates with the first and second sections of the side panel of the primary blank to define a first support structure.

19. The container of claim 18, wherein the third section of the secondary blank cooperates with the second and third sections of the side panel of the primary blank to define a second support structure.

20. The container of claim 19 wherein:

the first section of the bottom panel of the primary blank is folded about the fifth fold line to a position perpendicular to the first section of the side panel of the primary blank;

the second section of the bottom panel of the primary blank is folded about the sixth fold line to a position perpendicular to the second section of the side panel of the primary blank;

the third section of the bottom panel of the primary blank is folded about the seventh fold line to a position perpendicular to the third section of the side panel of the primary blank;

the fourth section of the bottom panel of the primary blank is folded about the eighth fold line to a position perpendicular to the fourth section of the side panel of the primary blank.

* * * * *